US008656616B2

(12) United States Patent
Ashpole et al.

(10) Patent No.: US 8,656,616 B2
(45) Date of Patent: Feb. 25, 2014

(54) CONVERTIBLE BUSINESS CARD WITH GAME

(71) Applicant: Bashpole Inventions, Inc., Philadelphia, PA (US)

(72) Inventors: Benjamin Ashpole, North Webster, IN (US); Jay Alan Olman, Philadelphia, PA (US)

(73) Assignee: Bashpole Inventions, Inc., Philadelphia, PA (US)

( * ) Notice: Subject to any disclaimer, the term of this patent is extended or adjusted under 35 U.S.C. 154(b) by 0 days.

(21) Appl. No.: 13/655,105

(22) Filed: Oct. 18, 2012

(65) Prior Publication Data

US 2013/0091747 A1 Apr. 18, 2013

Related U.S. Application Data

(60) Provisional application No. 61/548,575, filed on Oct. 18, 2011.

(51) Int. Cl.
*A63F 7/06* (2006.01)

(52) U.S. Cl.
USPC ..... 40/124.14; 40/539; 40/124.17; 273/317.5

(58) Field of Classification Search
USPC ..... 40/124.01; 273/317.3, 317.5; 446/46
See application file for complete search history.

(56) References Cited

U.S. PATENT DOCUMENTS

| | | | | |
|---|---|---|---|---|
| 2,220,536 | A | 11/1940 | Murray | |
| 3,100,642 | A * | 8/1963 | Goldstein | 206/579 |
| 5,465,961 | A * | 11/1995 | Burtch | 273/317.3 |
| 5,657,562 | A * | 8/1997 | Desormeaux | 40/124.01 |
| 5,836,616 | A | 11/1998 | Cooper | |
| 5,887,899 | A | 3/1999 | Dobbins | |
| 6,991,508 | B2 * | 1/2006 | McClung et al. | 446/46 |
| 7,775,525 | B2 * | 8/2010 | Staver et al. | 273/317.5 |
| 7,883,004 | B2 * | 2/2011 | Halbur et al. | 235/379 |
| 2003/0188465 | A1 | 10/2003 | Ruiz | |
| 2006/0273520 | A1 | 12/2006 | McDonald et al. | |
| 2008/0229633 | A1 | 9/2008 | Yi | |

* cited by examiner

*Primary Examiner* — Casandra Davis
(74) *Attorney, Agent, or Firm* — Panitch Schwarze Belisario & Nadel LLP

(57) ABSTRACT

A business card having an original state that is convertible into a game in a playable state is described. The business card includes a main body having a first side and a second side. The first side has marketing information marked thereon. The main body comprises a goal structure for playing the game in a playable state. One or more detachable components are attached to the main body in the original state. The one or more detachable components are detached from the main body for interacting with the main body in the playable state. The business card is produced in the original state and the game is not playable in the original state.

13 Claims, 4 Drawing Sheets

CONVERTIBLE BUSINESS CARD WITH GAME

BACKGROUND OF THE INVENTION

Business cards are a well-known and well understood method of conveying information, especially business information or contact information, between individuals or an individual and a company. Business cards in the United States are typically printed on twelve (12) point card stock, and are approximately 3.5 inches wide by 2 inches long. This size allows the business cards to be carried by both the owner and the recipient in a pocket, wallet, business card holder, or the like. Other business card sizes and card stock may also be used. A business card usually displays business and/or personal information such as a name, company affiliation, address, telephone number, fax number, website, email address, a logo, and the like. The appearance of a business card can range from traditional black text on white card stock to colorful and creative designs. Designs may include print on both sides, full color, raised or engraved print, novel materials, unusual shapes, and the like. Because there are great many business cards with relatively similar features, it is rare and valuable to have a business card that is memorable to its recipient.

Accordingly, it is desirable to provide a business card that allows a recipient to perceive the card giver's information in a unique, entertaining and/or interactive way. It is further desirable to increase the recipient's interaction with the business card by providing a game or other form of entertainment, thereby increasing the exposure and memorability of the business card to the recipient.

BRIEF SUMMARY OF THE INVENTION

In one embodiment, a business card having an original state that is convertible into a game in a playable state is described. The business card includes a main body having a first side and a second side. The first side has marketing information marked thereon. The main body comprises a goal structure for playing the game in a playable state. One or more detachable components are attached to the main body in the original state. The one or more detachable components are detached from the main body for interacting with the main body in the playable state. The business card is produced in the original state and the game is not playable in the original state.

In another embodiment, a method of producing a business card convertible into a game id described. Information is marked on at least one side of a first substrate. A goal structure is defined in the first substrate by one or more perforations or scored lines. One or more perforations are formed in the first substrate. The one or more perforations define one or more game pieces for interacting with the goal structure.

BRIEF DESCRIPTION OF THE DRAWINGS

The following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
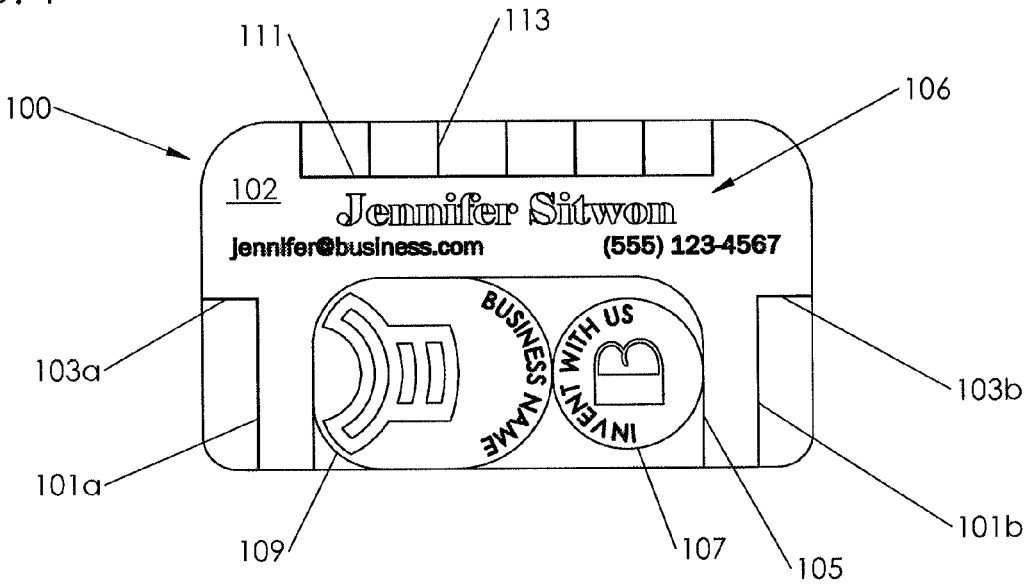
FIG. 1 is a front perspective view of a convertible business card, with a plurality of perforations and/or scored lines, for printing a table soccer or hockey style game card in accordance with a first embodiment of this invention.

Certain terminology is used in the following description for convenience only and is not limiting. The words "right", "left", "lower", and "upper" designate directions in the drawings to which reference is made. The terminology includes the above-listed words, derivatives thereof, and words of similar import. Additionally, the words "a" and "an", as used in the claims and in the corresponding portions of the specification, mean "at least one."

Referring to FIG. 1, a convertible business card 100 according to a first embodiment of the present invention is shown. The convertible business card 100 is preferably constructed on a substrate 102, such as twelve (12) point card stock, though it can be constructed from a different weight of paper (e.g., 50 pt.), or a different substrate 102 entirely, such as plastic, fabric, metal, or baked goods. In its flat state, the convertible business card 100 functions like a regular business card, to be passed from person to person. The convertible business card 100 conveys contact information 106 (e.g., personal information, business information, etc.) that is marked on a front and/or rear surface of the substrate 102 of the convertible business card 100. This information 106 can be applied to the card in a variety of ways, including, but not limited to, ink printing, type setting, engraving and laser etching. In a flat state, a plurality of convertible business cards 100 may be stacked together in order to minimize an amount of space required for storage, transport, and distribution.

As shown in FIG. 1, in its flat state, the convertible business card 100 includes a pattern for a playable game. The playable game of convertible business card 100 is a soccer or hockey style game. In its flat state, the convertible business card 100 has a plurality of perforations 101, 107, 109 and 113 that define a plurality of game pieces for easy tearing, and a plurality of scored lines 103 and 111 for bending, twisting, or the like. The perforations 101, 107, 109 and 113 are preferably made by introducing partial cuts through the thickness of the substrate 102 that designate a specific line or shape, with parts of the card remaining unpunctured in order to allow the substrate 102 to sturdily maintain its flat and uniform shape while in its flat state, yet allow for easy tearing or breaking along the designated lines or shapes with minimal force, effort, and skill. The scored lines 103 and 111, are cuts, depressions, creases, or the like that compress or partially penetrate through the thickness of the substrate 102. For example, the top surface of the substrate 102 may be broken but the bottom surface remains intact, thereby increasing the flexibility of the card along this line, though ensuring that the substrate 102 remains as one body.

The convertible business card 100 includes vertical perforations 101*a* and 101*b* at the lower ends of the substrate 102. Each perforation is preferably made a small distance from the right edge and left edge of the convertible business card 100. Horizontal scored lines 103*a* and 103*b* extend from each end of the perforations 101*a* and 101*b*, respectively, to the near side edges of the convertible business card 100. A generally rectangular shape 105 is preferably defined in the middle of the lower portion of the convertible business card 100. The rectangular shape 105 preferably partially defines a lower surface of the convertible business card 100. A first perforation 107 is defined at a first end of the rectangular shape 105. A second perforation 109 is defined at a second end of the rectangular shape 105. The first perforation 107 defines a circular shaped projectile that approximates the shape of a soccer ball or hockey puck. The second perforation 109 preferably defines a rectangular shape having rounded corners. However, other shapes of the first and second perforations 107, 109 may be defined without departing from the scope of this invention. Centered near the top of the convertible business card 100 is a horizontal scored line 111. The horizontal scored line 111 preferably extends across a majority of the horizontal surface of the convertible business card 100, a short distance from its top edge. Along the length of horizontal scored line 111, multiple vertical perforated lines 113 are defined. The perforated lines 113 extend from the horizontal scored line 11 to the top edge of the convertible business card 100.

In one embodiment, the plurality of perforations 101, 107, 109 and 113 and scored lines 103 and 111 may be cut into the substrate 102 of the convertible business card 100 using a device or a combination of devices, such as a cutter, laser, printer, cutting die, or any other technique suitable for cutting, etching, or forming the perforations 101, 107, 109 and 113 and scored lines 103 and 111 on the substrate 102 of the convertible business card 100. For example, a $CO_2$ laser, cutting on a flat bed with a CNC interface, such as the Trotec Speedy 500 (by Trotec Laser, Inc.), is able to create both the perforations 101, 107, 109 and 113 and scored lines 103 and 111 by varying the speed and power of the laser, and can also engrave the information 106. Preferably, the laser cutter has a large cutting bed and an automated feed in order to manufacture the convertible business cards 100 most efficiently. Furthermore, a printer may be used in tandem with a laser cutter to print contact information, logos, colors, or any other designs, either before or after the cutting operation. Alternately, a convertible business card 100 or an entire sheet comprising a plurality of convertible business cards 100 may be printed on either one or both sides of the material, after which the convertible business cards 100 may be cut and scored with a cutting die, either individually or simultaneously. The perforations 101, 107, 109 and 113 and scored lines 103 and 111 are arranged in a pattern that allows the convertible business card 100 to be converted to a second, playable state.

Figure 2:
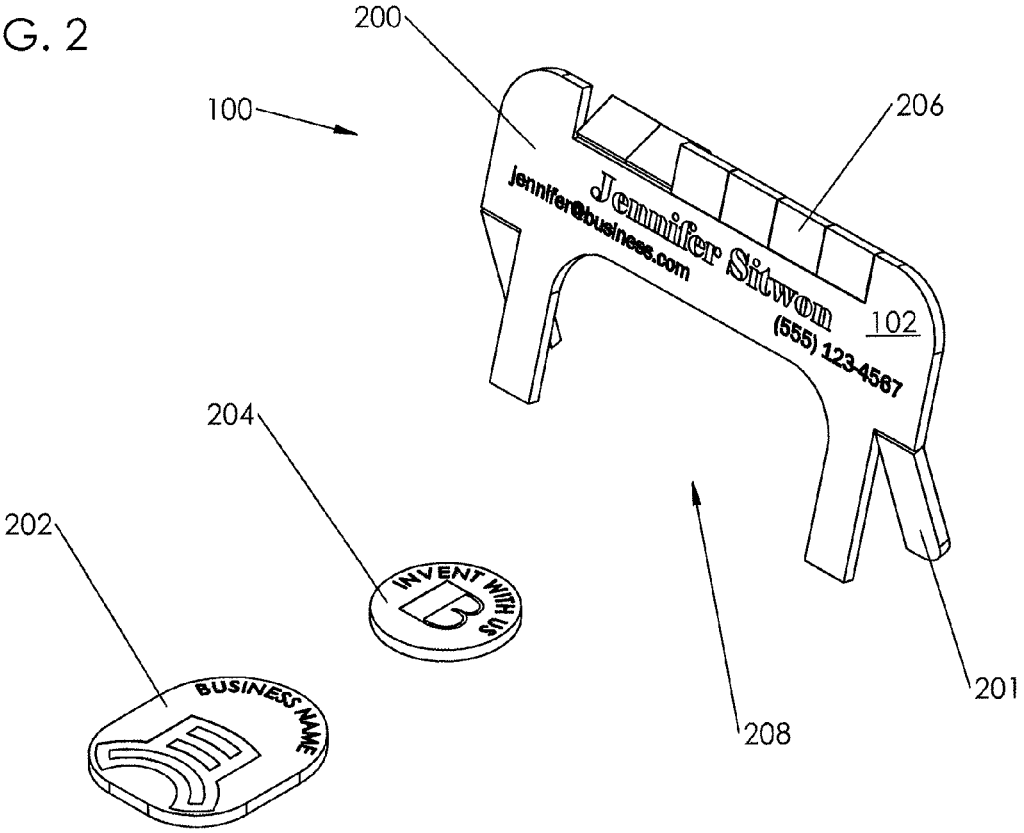
FIG. 2 is a perspective view of the convertible business card of FIG. 1 manipulated along the perforations and scored lines into its playable state.

FIG. 2 illustrates the convertible business card 100 of FIG. 1 in a converted state for playing a soccer or hockey style game. In the converted state, the convertible business card 100 of FIG. 1 includes a main body goal structure 200 and a plurality of separate game piece components, including a minor body paddle 202 (defined by the second perforation 109), and a minor body projectile 204 (defined by the first perforation 107). The goal structure 200 is a structure defined by at least a portion of the substrate 102 that is configured to interact with the one or more game pieces of the convertible business card 100. In the case that the game pieces include a projectile 204, the goal structure 200 is preferably a net, a goal post, a fence, a playing field, a flag, a target, or the like. However, other forms of the goal structure 200 are also within the scope of this invention. A scoreboard comprising a plurality of tabs 206 is defined at the top of the goal structure 200 by the plurality of vertical perforations 113. In another embodiment, the convertible business card 100 does not have the scoreboard 206. The goal structure 200 includes a plurality of goal structure supports 201, bent along their scored lines 103, allowing the goal structure 200 to be stood up vertically on a gameplay surface, such as a tabletop, desktop, floor, or the like.

During gameplay, the paddle 202 is used to contact the projectile 204 along the gameplay surface in order to get the projectile 204 into or through a scoring area 208, defined by the rectangular shape 105, within the goal structure 200. The tabs 206 of the scoreboard 206 can be folded down along the horizontal scored line 111 to keep track of points scored during the gameplay. In an alternative embodiment, the goal structure 200 may not have the structure supports 201. In this embodiment, the goal structure 200 lays flat on the gameplay surface, or may be stood up by an external support structure (not shown).

In yet another embodiment, a foreign object may be introduced to be used with the game of FIG. 2. For example, a coin (not shown) may be used as an extra paddle for scoring goals or for defending. Other common objects that could be incorporated into a game include, but are not limited to, rubber bands, pencils, pens, or keys. Such objects can be used to simulate items such as obstacles, pulleys, goals, targets, or any other objects or props that may be useful for playing the game of FIG. 2.

Preferably, the components of the convertible business card 100 are laid out so that the card maintains a desired shape, preferably rectangular, while it is in its flat state. The information 106 is preferably printed, etched, engraved, or otherwise marked on the main body of the card. It is preferable that the information 106 remains visible and intact both in the flat state and the converted state. Likewise, it is preferable that the removable components be located in areas of the card that contain no personal information and are intended to be removed or used as structural supports in order to maximize the amount of useful information displayed.

Figure 3A:
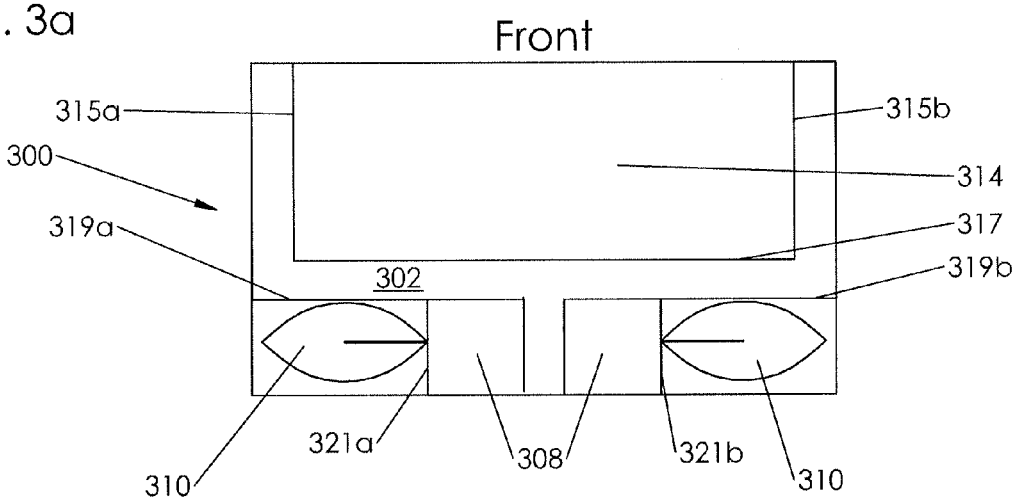
FIG. 3*a* is a front perspective of a convertible business card for printing a game card that has a multi-part projectile in accordance with a second embodiment of this invention.
Figure 3B:
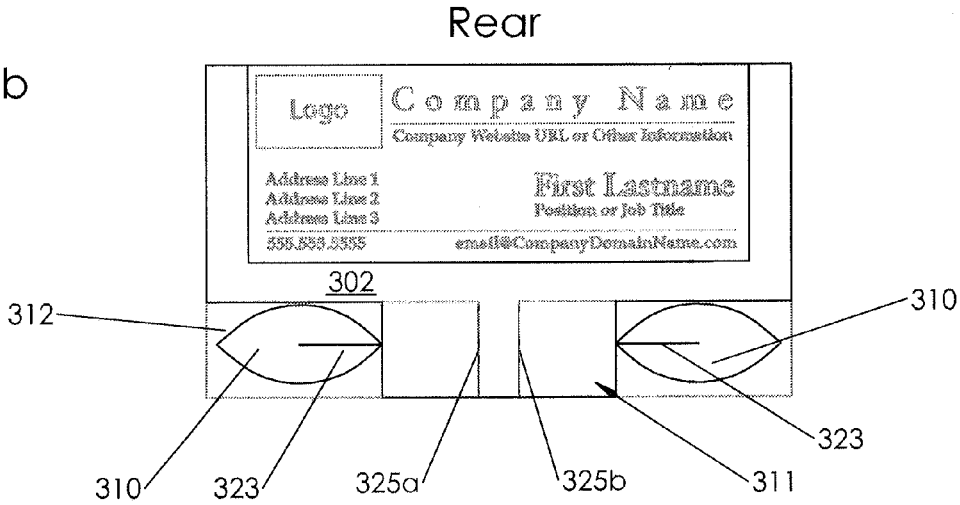
FIG. 3*b* is a rear perspective of a convertible business card for printing a game card that has a multi-part projectile in accordance with a second embodiment of this invention.
Figure 4:
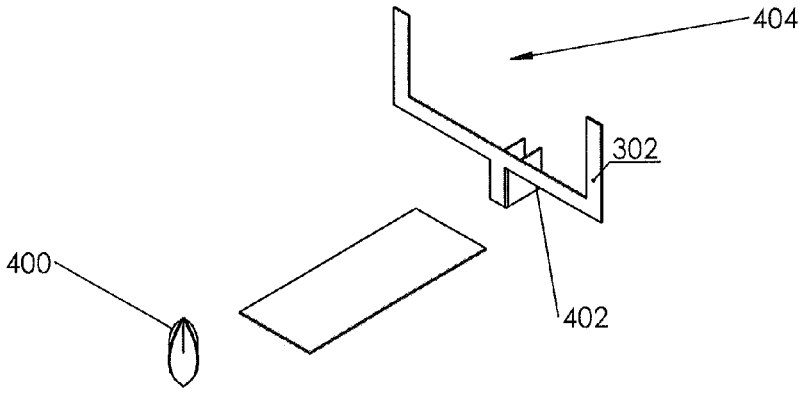
FIG. 4 is a perspective view of the convertible business card of FIG. 3 manipulated along the perforations and scored lines into its playable state.

Referring now to FIGS. 3*a*, 3*b*, and 4, a convertible business card 300 according to a second embodiment is shown. The convertible business card 300 may be converted from a first, flat, state into a second, playable, state having an American football or rugby style game in which a multi-part projectile 400 (FIG. 4) is launched from a surface through a goal structure 402 (FIG. 4). The convertible business card 300 includes the projectile 400 formed from a plurality of predetermined perforated portions 310 defined on the surface of the convertible business card 300. First and second projectile shaped portions 310 are defined on the surface of the convertible business card 300. The projectile shaped portions 310 fit together by slits 323 to form the three-dimensional multi-part projectile 400. Preferably, instructions 311 are printed on the surface of the convertible business card 300 in order to show the proper method of assembly. The multi-part projectile 400 preferably resembles a football or rugby ball, but may resemble any other type of projectile, including a baseball, basketball, soccer ball, or the like.

In its flat state, the convertible business card 300 includes a rectangular portion 314 that is defined by the top edge of the card substrate 302. Two perforated vertical lines 315*a* and 315*b* extend from the top edge of the convertible business card 300 substrate 302 toward the center of the card substrate 302. A perforated horizontal line 317 connects the ends of lines 315*a* and 315*b*. The vertical lines 315*a*, 315*b* and the horizontal line 317 define the goal structure 402 of the convertible business card 300. Two perforated horizontal lines 319*a* and 319*b* are defined below the perforated horizontal line 317. The perforated horizontal lines 319*a* and 319*b* extend from opposite side edges of the convertible business card 300, and are collinear. Perforated vertical lines 321*a* and 321*b* extend from the bottom edge of the convertible business card 300 connect with the perforated horizontal lines 319*a* and 319*b*, thereby creating two sections in the bottom corners of the convertible business card 300 where perforated projectile shaped sections 310 are located. Each of the projectile shaped sections 310 contains a perforated horizontal line 323. Foldable scored vertical lines 325*a* and 325*b* extend from the bottom edge of the card to the endpoints of lines 319*a* and 319*b* to define first and second support sections 308. Referring to FIGS. 3 and 4, the support sections 308 allow the goal structure 402 to be maintained in an upright position.

The convertible business card 300 may include excess material 312 in its interior or exterior areas that is not used to play the intended game. The excess material 312 preferably helps to support the removable game piece components of the convertible business card 300, or to increase the structural integrity of the convertible business card 300 in either of its first or second state. Field portion 314 is preferably a section of the convertible business card 300 that depicts a traditional football field on a first surface. The second surface of the field portion 314 preferably contains standard business and/or personal information found on a traditional business card.

Referring to FIG. 4, in the converted position, a user flicks the projectile 400 from a gameplay surface to simulate kicking a ball through goal posts into or through the goal post scoring area 404. In other embodiments, other three-dimensional projectiles could be created, as described above with reference to FIGS. 1 and 2. These projectiles may interact with the goal structure 402 by, for example, being bounced, hit, slid, or launched in any way to move around and simulate a miniature version of sports equipment or game pieces.

Figure 5A:
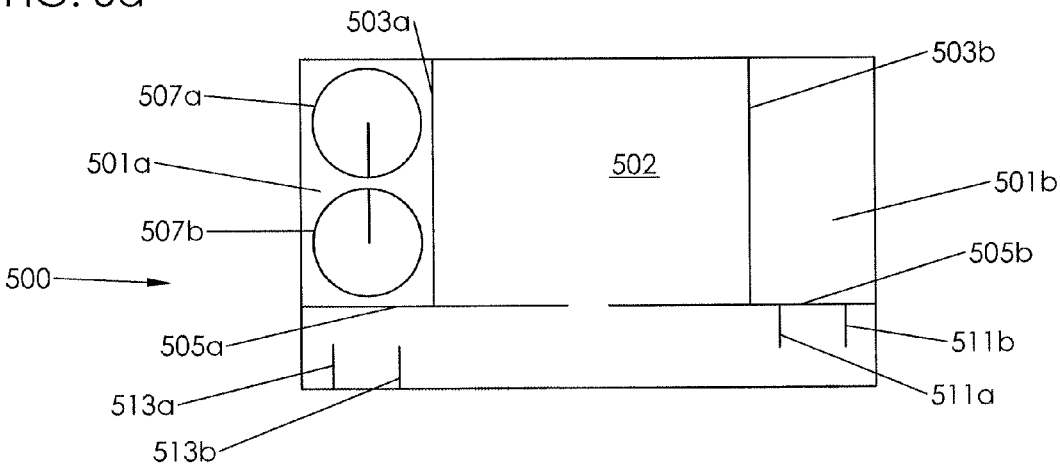
FIG. 5*a* is a front perspective view of a convertible business card including an adhesive-coated surface for playing a ball game in accordance with a third embodiment of this invention.
Figure 5B:
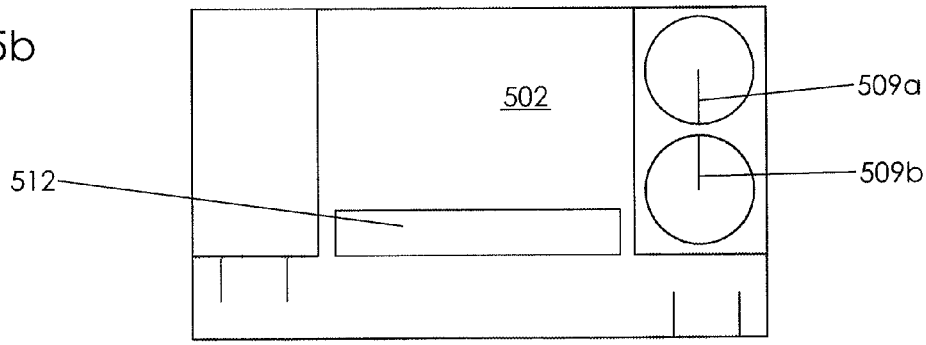
FIG. 5*b* is a rear perspective view of a convertible business card including an adhesive-coated surface for playing a ball game in accordance with a third embodiment of this invention.
Figure 6:
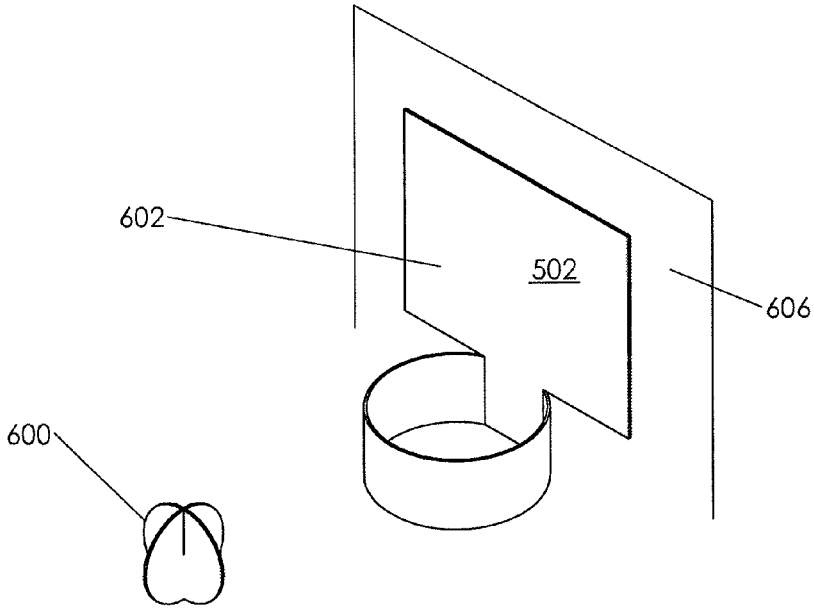
FIG. 6 is a perspective view of the convertible business card of FIG. 5 manipulated along the perforations and scored lines into its playable state.

FIGS. 5*a*, 5*b*, and 6 show a third embodiment of the convertible business card 500 having an adhesive-coated rear surface 512. Preferably, in a first, flat state, the adhesive surface is covered with a protective layer of material, or is attached to a different card as part of a stack of convertible business cards 500. The convertible business card 500, in its second, playable state, simulates a goal structure 602 in the shape of a basketball hoop, and a game piece projectile in the shape of a basketball 600.

In its first, flat, state, the convertible business card 500 comprises two rectangular, removable sections 501*a* and 501*b* defined at each edge of the card substrate 502. The removable sections 501*a* and 501*b* are bounded by the top and side edges of the convertible business card 500, perforated vertical lines 503*a* and 503*b* and horizontal lines 505*a* and 505*b*. Removable section 501*a* is generally rectangular in shape, and preferably contains two perforated circles 507*a* and 507*b* that together make up a basketball-shaped projectile 600. Circles 507*a* and 507*b* contain perforated radial lines 509*a* and 509*b*. Horizontal lines 505*a* and 505*b* extend beyond the edges of rectangles 501*a* and 501*b* toward the center of the card, but do not meet one another. On the right side of the card, perforated vertical lines 511*a* and 511*b* extend partially from line 505*b* toward, but not completely to, the bottom edge of the convertible business card 500 card substrate 502. On the left side of the card, perforated vertical lines 513*a* and 513*b* extend partially from the bottom edge of the card substrate 502 toward, but not completely to horizontal line 505*a*.

In the converted state, the basketball hoop portion is formed by inserting the slots created by the pair of perforated lines 511*a* and 513*a* into one another and doing the same with the pair of perforated lines 511*b* and 513*b*. This creates a circular loop large enough for projectile 600 to pass through. The goal structure 602 of the convertible business card 500 attaches to an anchor surface 606 using adhesive surface 512. The anchor surface 606 may be, for example, a wall, a shelf, a beverage container, a glass/mug/stein or the like. In another embodiment, the adhesive surfaces of the convertible business card 500 may be used to attach the goal structure 602 to other parts of other convertible business cards 500, rather than to external surfaces or objects.

Figure 7:
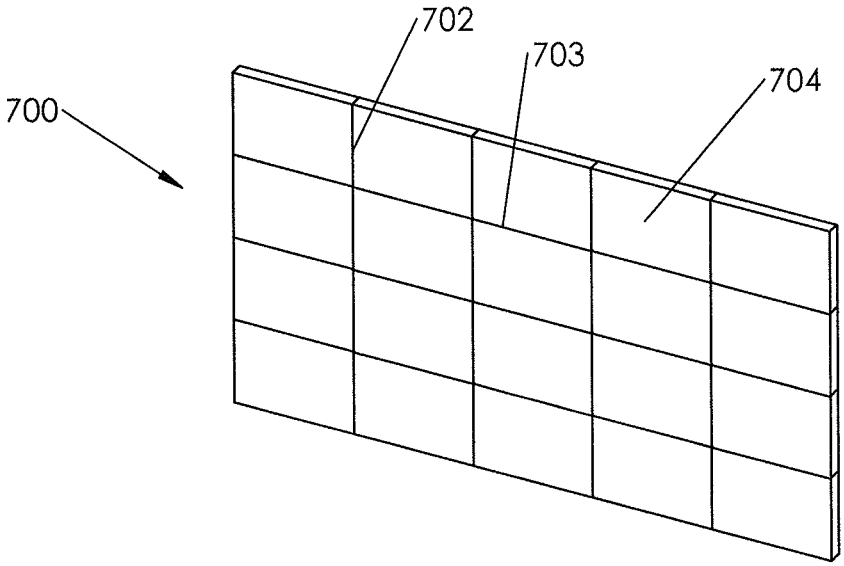
FIG. 7 is a perspective view of a convertible business card perforated in a grid pattern according to a fourth embodiment of this invention.

Referring now to FIG. 7, a fourth embodiment of a convertible business card 700 having a word or number game is described. The convertible business card 700 includes a grid of vertical perforations 702 and horizontal perforations 703. In its playable state, the convertible business card 700 is separated into many different pieces 704. The different pieces 704 are preferably rectangular. However, in alternate embodiments the pieces 704 may be any regular or irregular shape, such as circles, ellipses, trapezoids, squares or the like. In a preferred embodiment, one side of the convertible business card 700 includes a person's identification information, while the other side has one or several letters, numbers, punctuation marks, mathematical operators, symbols, or other markings in each section. When the pieces are separated, they form crossword-style games, mathematical games, or any other games that are conducive to arranging tiles with markings, colors, or symbols.

While the first, second, third and fourth embodiments have been described in terms of convertible business cards 100, 300, 500 and 700, other convertible mass marketing materials may be constructed as described above. Such other mass marketing materials are within the scope of this invention. Specifically, mass marketing materials that may be convertible as described above include, but are not limited to flyers, pamphlets, posters, envelopes, postcards, placards, and brochures. These mass marketing materials may be manufactured in the same manner as described above with respect to the convertible business cards 100, 300, 500 and 700.

Even though ordinary business cards are often made out of paper, the convertible business cards 100, 300, 500 and 700 may be constructed from a plurality of different materials without departing from the scope of this invention. Such materials include, but are not limited to metals, plastics, fabrics, and foods. Furthermore, the convertible business cards 100, 300, 500 and 700 can be printed on any size of paper stock, or on a card that is not used as a business card. Additionally, though each embodiment described above depicts a specific game, other games, such as checkers, chess, tic-tac-toe, four in a row game, and design variations of the convertible business cards 100, 300, 500 and 700 can be created without departing from the scope of this invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A business card having an original state, the business card being convertible into a playable state for playing a game, the business card comprising:

a main body having a first side and a second side, the first side having information marked thereon, the main body including a goal structure for playing the game in the playable state; and one or more detachable components attached to the main body in the original state, the one or more detachable components being detachable from the main body so as to interact with the goal structure in the playable state, and the business card being produced in the original state so that the game is not playable in the original state, wherein in the original state, the one or more detachable components are coupled to the main body by one or more perforations, the main body including one or more support structures defined by one or more scored lines, the support structures maintaining the main body in an upright position in the playable state when folded about a fold line, and wherein the one or more detachable components comprise a multi-part projectile.

2. The business card of claim 1, wherein the game is an American football or rugby style game.

3. The business card of claim 2, wherein the main body comprises a goal post structure.

4. The business card of claim 2, wherein the one or more detachable components comprises a field portion having a field side and an information side, wherein the field side illustrates a sports field, and the information side includes personal or business information marked thereon.

5. The business card of claim 1, wherein the one or more detachable components include a projectile and a paddle.

6. The business card of claim 1, wherein the information marked on the first side includes personal or business contact information.

7. A method of producing a business card having an original state convertible into a game having a playable state, the method comprising:

a. marking contact information on at least one side of a first substrate;

b. defining a goal structure in the first substrate, the goal structure defined by one or more perforations or scored lines; and c. forming one or more perforations in the first substrate, wherein the one or more perforations define one or more game pieces of a multi-part projectile for interacting with the goal structure; and d. forming one or more support structures defined by one or more scored lines, folding the support structures about a fold line thereby maintaining the goal structure in an upright position in the playable state.

8. A business card having an original state, the business card being convertible into a playable state for playing a game, the business card comprising:

a main body having a first side and a second side, the first side having personal or business information marked thereon, the main body including a goal structure for playing the game in the playable state; and one or more detachable components attached to the main body in the original state, the one or more detachable components being detachable from the main body so as to interact with the goal structure in the playable state, and the business card being produced in the original state so that the game is not playable in the original state, wherein in the original state, the one or more detachable components are coupled to the main body by one or more perforations, wherein the main body includes one or more support structures defined by one or more scored lines, the support structures maintaining the main body in an upright position in the playable state when folded about a fold line, and wherein the one or more detachable components comprise a projectile and a paddle.

9. The business card of claim 8, wherein the game is a hockey game.

10. The business card of claim 9, wherein the goal structure defines an opening for interacting with the projectile.

11. A business card having an original state, the business card being convertible into a playable state for playing a game, the business card comprising:

a main body having a first side and a second side, the first side having information marked thereon, the main body including a goal structure for playing the game in the playable state; and one or more detachable components attached to the main body in the original state, the one or more detachable components being detachable from the main body so as to interact with the goal structure in the playable state, and the business card being produced in the original state so that the game is not playable in the original state, wherein in the original state, the one or more detachable components are coupled to the main body by one or more perforations, the main body including one or more support structures defined by one or more scored lines and an adhesive strip, the support structures maintaining the main body in an upright position in the playable state when the support structure is attached to an anchor surface using the adhesive strip, and wherein the one or more detachable components comprise a multi-part projectile.

12. The business card of claim 11, wherein the game is a basketball style game.

13. The business card of claim 12, wherein the goal structure includes a circular shaped basketball hoop that is large enough to allow the multi-part projectile to pass therethrough.

* * * * *